US005734726A

United States Patent [19]

Truchsess

[11] Patent Number: 5,734,726

[45] Date of Patent: Mar. 31, 1998

[54] DEVICE AND METHOD FOR CONTROLLING DIGITALLY-STORED SOUNDS TO PROVIDE SMOOTH ACCELERATION AND DECELERATION EFFECTS

[75] Inventor: Joseph F. Truchsess, City Island, N.Y.

[73] Assignee: Pragmatic Designs, Inc., City Island, N.Y.

[21] Appl. No.: 778,859

[22] Filed: Jan. 2, 1997

Related U.S. Application Data

[63] Continuation of Ser. No. 147,074, Nov. 3, 1993, abandoned.

[51] Int. Cl.[6] ..... H03G 3/20

[52] U.S. Cl. ..... 381/61; 84/626; 84/604

[58] Field of Search ..... 381/61; 446/408, 446/409; 84/604, 605, 606, 626, 627, 615, 618, 653, 656, 658

[56] References Cited

U.S. PATENT DOCUMENTS

| | | | |
|---|---|---|---|
| 4,080,862 | 3/1978 | Hiyoshi et al. | 84/626 |
| 4,373,722 | 2/1983 | Kite et al. | 273/85 G |
| 4,464,784 | 8/1984 | Agnello | 381/61 |
| 4,785,702 | 11/1988 | Katoh | 84/604 |
| 4,932,913 | 6/1990 | Raviv et al. | 446/404 |
| 4,946,416 | 8/1990 | Stern et al. . | |
| 5,061,905 | 10/1991 | Truchsess . | |
| 5,088,955 | 2/1992 | Ishimoto | 446/409 |

FOREIGN PATENT DOCUMENTS

| | | | |
|---|---|---|---|
| 4152395 | 5/1992 | Japan | 381/61 |

*Primary Examiner*—Curtis Kuntz
*Assistant Examiner*—Ping W. Lee
*Attorney, Agent, or Firm*—Cohen, Pontani, Lieberman & Pavane

[57] ABSTRACT

A device and method for producing sound which simulates the sound of an engine, whereby sound segments are digitally stored in memory and accessed by a microcontroller which is responsive to a user accessible switch. When the switch is activated and the device is producing an acceleration or deceleration sound, the device will "match" the acceleration or deceleration sound with a closely matched deceleration or acceleration sound, respectively, so that a realistic engine sound is produced.

17 Claims, 5 Drawing Sheets

DEVICE AND METHOD FOR CONTROLLING DIGITALLY-STORED SOUNDS TO PROVIDE SMOOTH ACCELERATION AND DECELERATION EFFECTS

This is a continuation of application Ser. No. 08/147,074, filed Nov. 3, 1993, now abandoned.

1. Field of the Invention

The present invention relates to electronic circuits which generate an audio-frequency signal which can be amplified and played through a loudspeaker and whose characteristics simulate those of an accelerating and decelerating engine or other sound whose pitch increases and decreases in response to user input, for use primarily in toys and games.

2. Prior Art

A variety of devices and methods have been used to generate vehicle engine sounds for use in toys, games and other such devices. The earliest of these were mechanical or electromechanical devices which spun toothed wheels against "flappers", either by means of an electric motor or by the "human power" of the child pushing the toy. These prior art systems suffered several drawbacks, including, a lack of realism, large size, and mechanical complexity.

More recently, electronic devices have been incorporated into products to produce vehicle engine sounds. Electronic simulations have been achieved with simple circuits employing oscillators as disclosed in U.S. Pat. No. 5,061,905, and microcomputer sound synthesis techniques have been used for electronic simulation. These techniques provide low-to-moderate realism at low cost.

In other prior art devices, such as disclosed in U.S. Pat. No. 4,946,416, sampled digitized recordings of engine sounds have been used in conjunction with a microcomputer, wherein the microcomputer varies the "engine speed" by changing the sample playback rate of the stored sounds. The tonal quality of the resultant sound, however, loses realism as the sample playback rate deviates from the original recording sample rate.

Other products have employed a specialized integrated circuit sound playback device wherein an acceleration sound and a deceleration sound are stored. The specialized sound playback devices, commonly referred to as "voice IC's", contain in one integrated circuit the various circuit elements for playback of digitized sound, i.e., control logic, memory, decoding circuitry if data compression is used, and a digital-to-analog converter (DAC). Since recordings of real sounds are stored, this technique provides realistic sounds. It has deficiencies, however, in simulating the action of a vehicle accelerator pedal because, as the acceleration and deceleration sounds are stored as complete sounds and always start at their respective beginnings, the tonal pitch of the beginning of a sound may not match the pitch of the sound which was playing at the moment the accelerator was pressed or released. This produces large, unpleasing, and unrealistic discontinuities in the pitch of the engine sound.

Accordingly, it is an object of the present invention to provide a device for generating realistic sounds resembling engine sounds for toy vehicles, wherein the tonal pitch of the sounds can be readily varied in order to produce simulated "acceleration" and "deceleration" of engines.

It is a further object of the invention to provide a method of generating realistic sounding acceleration and deceleration engine sounds which may be controlled by pressing and releasing a switch.

It is still a further object of the invention to provide such a means of sound generation whereby the user can control the pitch of the sound produced by varying the length of time the accelerator is activated relative to the length of time it is deactivated.

These and many other objects and advantages of the present invention will be readily apparent to one of ordinary skill in the art upon reading the detailed description, the appended drawings and claims.

SUMMARY OF THE INVENTION

Figure 1:
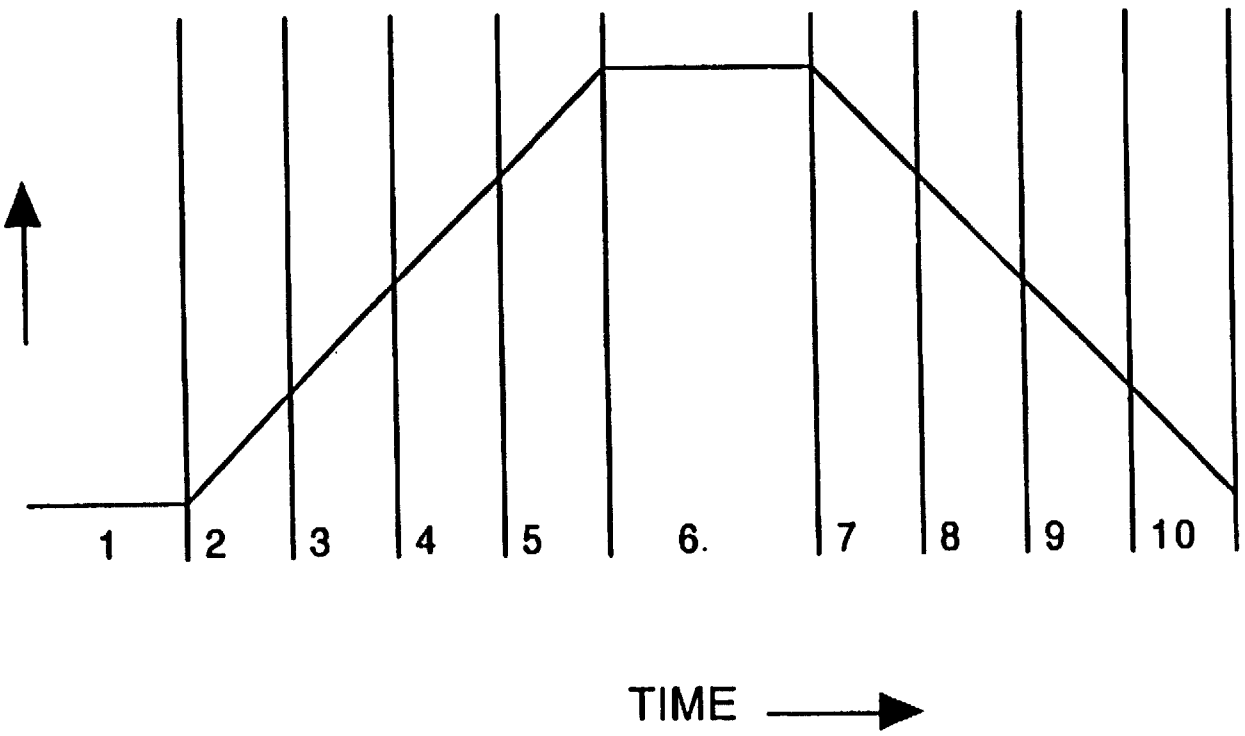
FIG. 1 shows the time division of the accelerating and decelerating engine sound into individually-playable segments.

Broadly speaking, the present invention is a sound generating device for simulating auto engines and other motors. The device comprises a first plurality of data corresponding to a first plurality of sounds, a second plurality of data corresponding to a second plurality of sounds, wherein some of the second plurality of sounds share a common sound characteristic with the sounds in the first plurality of sounds, storing means for storing the first and second pluralities of data, and a speaker. The device also comprises accessing means for accessing the storing means for outputting the first plurality of data in a first predetermined sequence to the speaker for generating the first plurality of sounds, and for outputting the second plurality of data in a second predetermined sequence to the speaker for generating the second plurality of sounds, designating means for designating a sound in the second plurality of sounds having the common sound characteristic with the sound in the first plurality of sounds output to the speaker when the first plurality of data is output to the speaker in the first predetermined sequence for generating the first plurality of sounds and for designating a sound in the first plurality of sounds having the common sound characteristic with the sound in the second plurality of sounds output to the speaker when the second plurality of data is output to the speaker in the second predetermined sequence for generating the second plurality of sounds, and switching means for switching between the first and second pluralities of sounds, the switching means cooperating with the designating means for outputting the second plurality of sounds to the speaker in the predetermined sequence starting with the designated sound in the second plurality of sounds when the switching means is activated when the first plurality of sounds is being output to the speaker, and for outputting the first plurality of sounds to the speaker in the predetermined sequence starting with the designated sound in the first plurality of sounds when the switching means is activated when the second plurality of sounds is being output to the speaker.

The present invention also provides a method of producing engine and motor sounds. The method comprises the steps of (1) providing a first plurality of data corresponding to a first plurality of sounds, (2) providing a second plurality of data corresponding to a second plurality of sounds, wherein some of the second plurality of sounds share a common sound characteristic with the sounds in the first plurality of sounds, (3) storing the first and second pluralities of data in a storing means, (4) accessing the storing means, (5) outputting the accessed data to a speaker so that the first plurality of data is output in a first predetermined sequence to the speaker for generating the first plurality of sounds and the second plurality of data is output in a second predetermined sequence to the speaker for generating the second plurality of sounds, (6) designating a sound in the second plurality of sounds having the common sound characteristic with the sound in the first plurality of sounds output to the speaker when the first plurality of data is output to the speaker in the first predetermined sequence for generating the first plurality of sounds and for designating a sound in the first plurality of sounds having the common sound characteristic with the sound in the second plurality of sounds output to the speaker when the second plurality of data is output to the speaker in the second predetermined sequence for generating the second plurality of sounds, and (7) switching between the first and second pluralities of sounds, so that when the switching occurs, if the first plurality of sounds is being output to the speaker, the second plurality of sounds will be output to the speaker in the second predetermined sequence starting with the designated sound in the second plurality of sounds and, if the second plurality of sounds is being output to the speaker, the first plurality of sounds will be output to the speaker in the first predetermined sequence starting with the designated sound in the first plurality of sounds.

The foregoing as well as additional details of the present invention will be more fully apparent from the following detailed description and annexed drawings of the presently preferred embodiments thereof.

DETAILED DESCRIPTION OF THE PREFERRED EMBODIMENT

Figure 4:
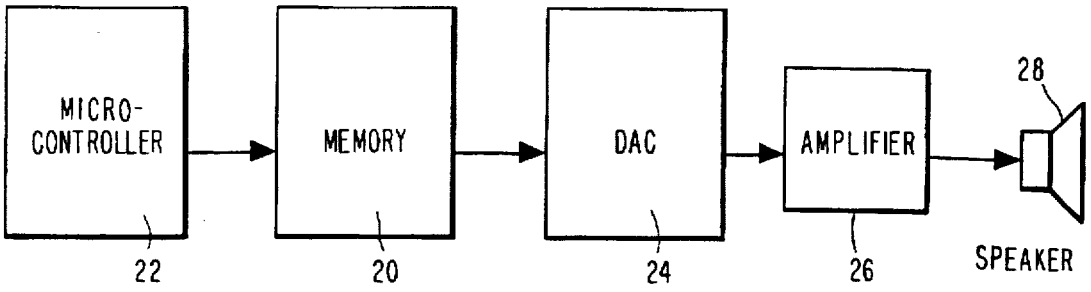
FIG. 4 is a block diagram of a typical application configuration using discrete circuit elements under control of an external microcontroller.

The invention relates to a device and method for playing various stored sound segments in a pre-determined order to simulate the sounds of an engine or motor under control of a user who presses and releases a switch S1 which preferably resembles an accelerator pedal of a car or a throttle of a motorcycle. Referring to FIGS. 1 and 4, a recording of the sound of an engine idling, accelerating to maximum pitch, holding at maximum pitch, and decelerating back to idle has been divided timewise into a number of segments numbered 1–10 which comprise two pluralities of sounds, i.e. the first plurality comprises "acceleration" sounds (segments 1–6) and the second plurality comprises "deceleration" sounds (segments 7–10). The segments of the first and second pluralities of sounds are digitally stored in memory 20 and can be accessed (played) separately by a microcontroller 22 which outputs each plurality of segments in a predetermined sequence to a digital-to-analog converter 24 which converts the segments to an analog signal. The analog signal is then amplified by an amplifier 26 and output to a speaker 28. The number and length of the segments is arbitrary and 4 to 8 segments of roughly 100 ms in length each for both acceleration and deceleration is presently preferred for adequate engine simulation. The pitch of the engine sound increases during acceleration segments, and decreases during deceleration segments. A minimum speed (idle) segment, i.e. segment 1, and a maximum speed segment, i.e. segment 6, are also stored, during which the engine pitch remains fairly constant.

Prior to playing any sound segment, a jump vector is stored in memory 20. This vector instructs the microcontroller 22 as to which segment will be played next should the switch S1 be activated, thereby interrupting the sequence of the first or second pluralities of sounds being played. By selecting vectors which match acceleration and deceleration segments of approximately the same pitch, a natural-sounding simulation of an actual engine is produced.

Should no interrupt be generated (i.e. the accelerator is not released during acceleration nor pressed during deceleration), the sounds play in sequential order. For example, if the accelerator is pressed and held, the acceleration segments will play sequentially until a "maximum speed" is reached, whereupon the maximum speed engine sound (segment 6) is played repeatedly until the accelerator is released. If the accelerator is then released and left released, the deceleration segments, i.e. segments 7–10, will play sequentially until the minimum speed ("idle") is reached, whereupon the idle (segment 10) will play repeatedly until the accelerator is pressed again. Should the accelerator be released during an acceleration segment or pressed during a deceleration segment, thereby generating an interrupt, the jump vector will direct the microcontroller 22 to immediately play the deceleration or acceleration segment, respectively, whose pitch most closely matches that of the segment which was interrupted.

It can be seen that by varying the application of the accelerator, the operator can control the pitch of the sound in a manner closely emulating the operation of a real engine. If the accelerator is applied briefly, the pitch of the sound will rise briefly and fall back to idle. If the accelerator is applied for a longer time, the pitch will increase to a greater frequency. If the accelerator is released briefly from a high pitch, the pitch will start to decelerate from that high pitch. If the accelerator is then reapplied, the pitch will immediately begin to rise again.

Figure 2A:
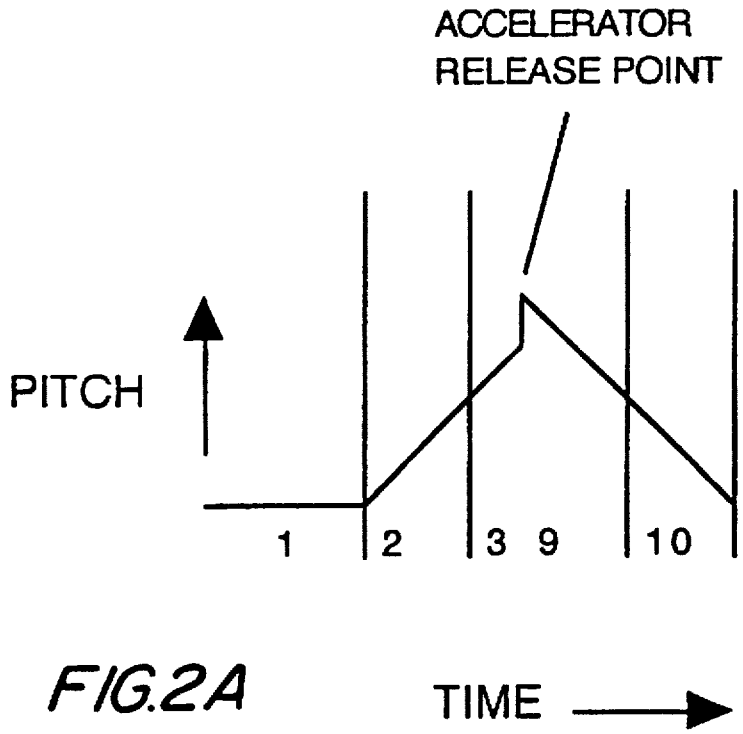
FIG. 2A and 2B show several examples of the sound sequencing produced by the present invention.
Figure 2B:
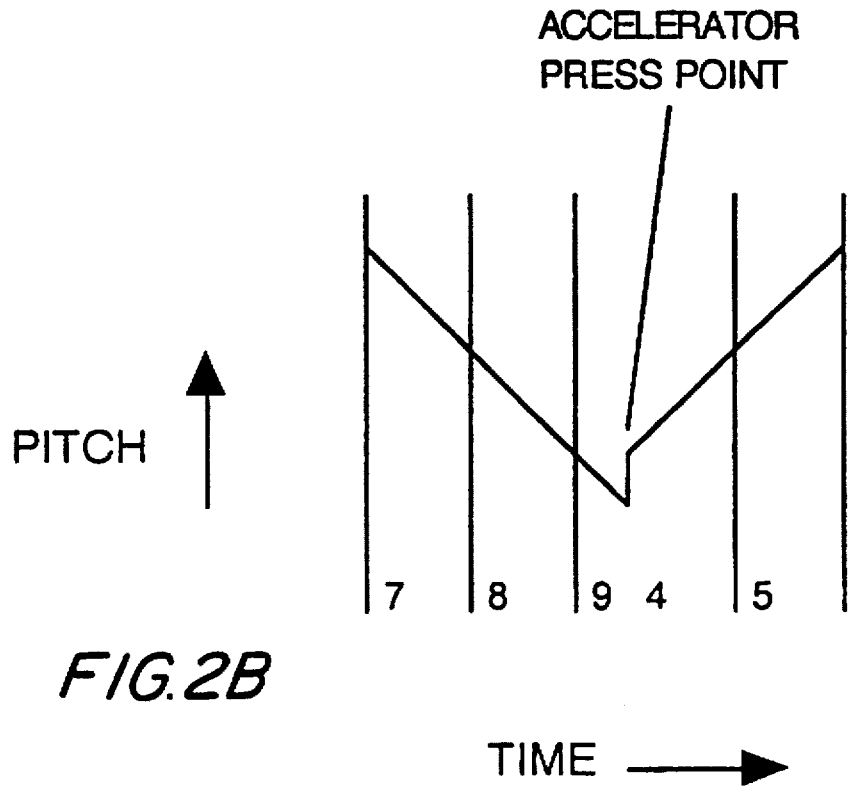

Referring now to FIG. 2A and 2B, examples of switching between accelerating and decelerating segments are shown. In FIG. 2A the accelerator has been released during playback of segment 3. The microcontroller 22 directs the memory 20 to then play segment 9, which is the segment most closely matching the pitch of segment 3. In FIG. 2B the accelerator has been pressed during playback of deceleration segment 9. The controller 22 directs the memory 20 to then play the acceleration segment which most closely matches the pitch of segment 9. It should be noted that decreasing the length of the segments (and typically, increasing their number) will provide more time resolution and hence closer pitch matching between segments.

Figure 3:
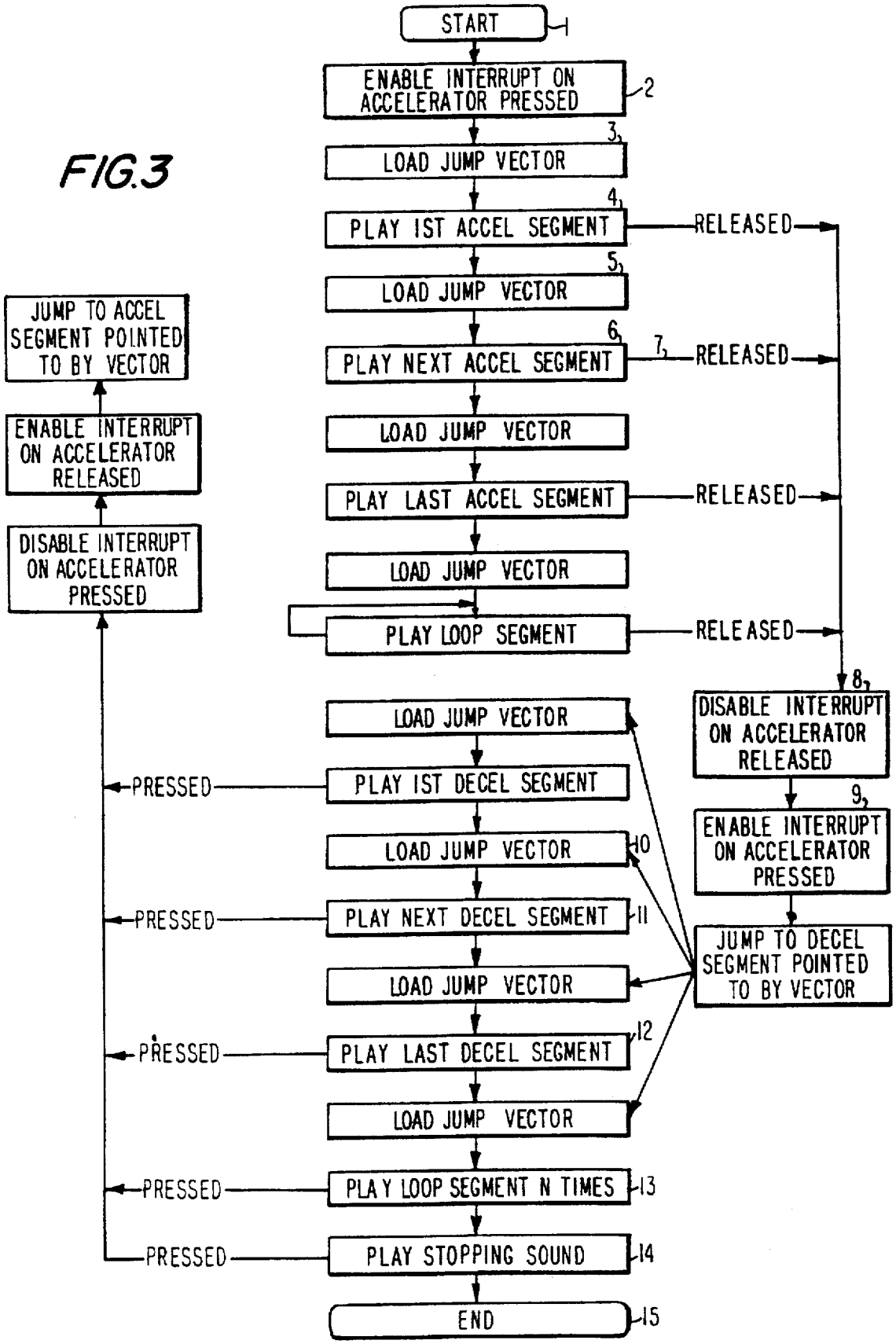
FIG. 3 is a drawing of a flowchart employed in the microcontroller of the present invention.

As noted above, it is presently preferred to implement the present invention by employing a microcontroller. Referring now to FIG. 3, a drawing of the flowchart of a program incorporated in the microcontroller 22 is shown. For clarity, only three acceleration segments and three deceleration segments are shown. It can be seen that many paths are possible through the logic, however, since the general structure of all paths in the algorithm is similar, only some of the paths are explained in detail below and the step numbers are shown in parenthesis.

Beginning at START (1), the program enables interruption on pressing of the accelerator switch (2). A jump vector is then stored (3), which will direct the program should it be interrupted by accelerator release. The first acceleration segment is then played (4). Should the first segment end without interruption, a new jump vector is stored (5) which replaces the existing jump vector and the next acceleration segment is played (6). Should the accelerator be released during playback of an acceleration segment, an interrupt (7) is generated, causing the program to jump to a common interrupt location (8), whereupon the accelerator release interrupt is disabled and the accelerator press interrupt is enabled (9). The program then jumps to the location (10) pointed to by the jump vector. At this location a new jump vector is stored which will direct the program should it be interrupted by subsequent accelerator activity. The deceleration segment thus pointed to (previously chosen to approximate the pitch of the segment which was interrupted) is then played (11). Should this deceleration segment end without interruption, a new jump vector is stored and the next deceleration segment will be played (12). After the last deceleration segment has been played the minimum speed idle sound may be repeatedly played (13). The preferred embodiment also includes an automatic shutoff, whereupon after playing the idle sound a predetermined number of times, a stopping sound is played (14) and the device is then turned off (15).

It should be noted that the choices of sound partitioning points and jump vectors are of importance in determining the resultant sound's characteristics. By careful selection of these parameters, various acceleration and deceleration effects may be achieved. In general, making the segments shorter will result in less pitch mismatch between segments and a greater degree of pitch control by the operator. Thus, as can now be appreciated, the present invention provides for a realistic simulation of an engine sound as it accelerates and decelerates.

Figure 5:
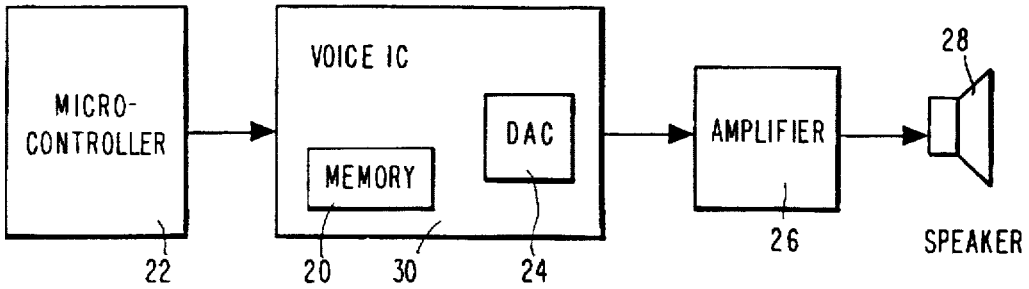
FIGS. 5 and 6 are alternate block diagrams of typical application configurations for implementing the present invention.
Figure 6:
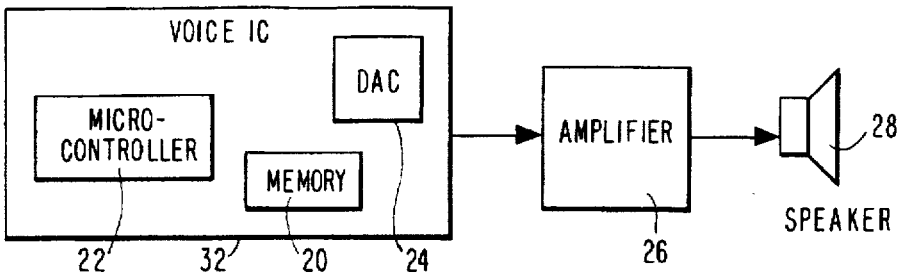

Referring now to FIGS. 5 and 6, alternative implementations of the microcontroller 22 and sound playback hardware are shown. FIG. 5 shows a voice IC 30 controlled by microcontroller 22. The voice IC 30 contains integrated memory and a digital-to-analog converter (DAC) 24. FIG. 6 shows a highly-integrated system wherein the microcontroller, memory and DAC are all incorporated in a voice IC 32.

Figure 7:
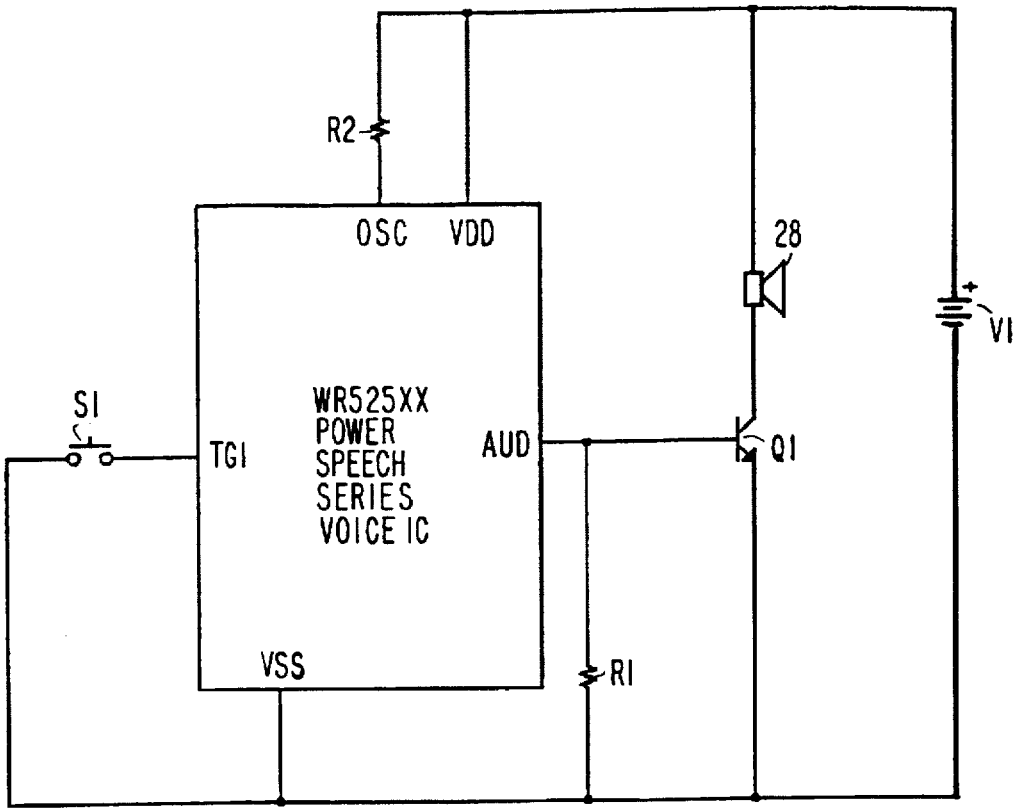
FIG. 7 is a schematic diagram of a typical application circuit used in the present invention.

Referring now to FIG. 7, a schematic representation of a typical circuit employing the voice IC 32 of FIG. 6 is shown. As shown, the voice IC has an input switch 51 which, in the preferred embodiment is an accelerator pedal, for interrupting the analog signal output on output AUD to the base of the transistor-amplifier Q1, for playing on speaker 28. As shown, the voice IC 32 also has peripheral resistors R1 and R2 and is powered by a battery cell V1.

Although I have herein shown and described a preferred embodiment of the present invention and suggested various changes and modifications thereto, it will be readily apparent to those of ordinary skill in the art who have read the foregoing description that still additional changes and modifications may be made. For example, the microcontroller could be programmed to poll the switch accelerator input instead of generating a hardware interrupt. In addition, a different variant might be used to duplicate the interrupt enabling/disabling steps at each interrupt vector and then jump to the various re-entry points, i.e. essentially replacing the jump vector of the preferred embodiment with an interrupt vector. Furthermore, a "starting" sound could be played before the "idle" sound when the device is first activated, and other sound effects, i.e. voices, horns, sirens, etc. can be incorporated and activated by additional inputs. As these as well as further changes and modifications are intended to be within the scope of the present invention, the foregoing description should be construed as illustrative and not in a limiting sense, the scope of the invention being defined by the following claims.

I claim:

1. A user-controllable device for sequencing sounds, comprising:

storing means for storing a first plurality of data segments corresponding to a first plurality of sounds having more than one pitch and a second plurality of data segments corresponding to a second plurality of sounds having more than one pitch, wherein each data segment includes at least one cycle of a sound wave;

accessing means for accessing said storing means for outputting said first plurality of data segments in a first predetermined sequence for generating said first plurality of sounds, and for outputting said second plurality of data segments in a second predetermined sequence for generating said second plurality of sounds;

designating means for continuously and sequentially designating each of said second plurality of data segments corresponding with a data segment in said first predetermined sequence as said each data segment in said first predetermined sequence is sequentially accessed by said accessing means for generating said first plurality of sounds; and switching means responsive to activation by a user for switching said accessing means between said first and second pluralities of data segments, said switching means cooperating with said designating means so that upon activation of said switching means, accessing of said first plurality of data segments is interrupted and thereafter accessing of said second plurality of data segments begins with the data segment which was last designated by said designating means for generating said second plurality of sounds in said second predetermined sequence.

2. The device of claim 1, wherein said accessing means and said designating means comprise a microcontroller.

3. The device of claim 1, where said designating means for designating a data segment of said second plurality of data segments having a substantially common pitch corresponding to a data segment of said first plurality of data segments.

4. The device of claim 1, wherein said switch is a user accessible pedal.

5. The device of claim 1, wherein each of said first plurality of data segments has a one-to-one correspondence with each of said second plurality of data segments such that each of said first plurality of data segments contains a representation of a sound having a sound characteristic that is similar to one of said second plurality of data segments.

6. The device of claim 5, wherein the sound characteristic is pitch.

7. The device of claim 5, wherein the sound characteristic is loudness.

8. The device of claim 1, wherein the data segments of said first predetermined sequence are accessed in an ascending pitch order.

9. The device of claim 1, wherein the data segments of said second predetermined sequence are accessed in a descending pitch order.

10. The device of claim 1, further comprising a digital-to-analog converter responsive to said accessing means for receiving and converting the data segments from said accessing means to analog signals, and a speaker responsive to said digital-to-analog converter for receiving and converting the analog signals to sounds.

11. A method of sequencing sounds comprising the steps of:

storing in a storage device a first plurality of data segments corresponding to a first plurality of sounds having more than one pitch and a second plurality of data segments corresponding to a second plurality of sounds having more than one pitch, wherein each data segment includes at least one cycle of a sound wave;

accessing said first and second pluralities of data segments in said storage device to output said first plurality of data segments in a first predetermined sequence for generating said first plurality of sounds, and to output said second plurality of data segments in a second predetermined sequence for generating said second plurality of sounds;

designating continuously and sequentially each of said second plurality of data segments corresponding with a data segment in said first predetermined sequence as said each data segment in said first predetermined sequence is sequentially accessed for generating said first plurality of sounds; and switching, in response to activation by a user, between said first and second pluralities of data segments, so that upon activation, accessing of said first plurality of data segments is interrupted and thereafter accessing of said second plurality of data segments begins with the data segment which was last designated during the designating step for generating said second plurality of sounds in said second predetermined sequence.

12. The method of claim 11, whereto each of said first plurality of data segments has a one-to-one correspondence with each of said second plurality of data segments such that each of said first plurality of data segments contains a representation of a sound having a sound characteristic that is similar to one of said second plurality of data segments.

13. The method of claim 12, wherein the sound characteristic is pitch.

14. The method of claim 13, wherein the data segments of said first predetermined sequence are accessed in an ascending pitch order.

15. The method of claim 13, wherein the data segments of said second predetermined sequence are accessed in a descending pitch order.

16. The method of claim 12, wherein the sound characteristic is loudness.

17. The method of claim 11, further comprising the steps of converting the data segments from said accessing step to analog signals, and then converting the analog signals to sounds.

* * * * *